US007729653B2

(12) United States Patent
Kawamoto et al.

(10) Patent No.: US 7,729,653 B2
(45) Date of Patent: Jun. 1, 2010

(54) IMAGE FORMING APPARATUS CAPABLE OF CLEANING A PHOTORECEPTOR, METHOD FOR CLEANING A PHOTORECEPTOR, AND COMPUTER PROGRAM FOR CAUSING AN IMAGE FORMING APPARATUS TO CLEAN A PHOTORECEPTOR

(75) Inventors: Hiroshi Kawamoto, Tenri (JP); Jitsuo Masuda, Yamatotakada (JP); Masayasu Narimatsu, Soraku-gun (JP); Naoki Fukudo, Shiki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 887 days.

(21) Appl. No.: 11/588,228

(22) Filed: Oct. 27, 2006

(65) Prior Publication Data

US 2007/0098471 A1 May 3, 2007

(30) Foreign Application Priority Data

Oct. 27, 2005 (JP) ..... 2005-313209

(51) Int. Cl.
*G03G 21/00* (2006.01)

(52) U.S. Cl. ..... 399/343; 399/344; 399/347

(58) Field of Classification Search ..... 399/343, 399/344, 347

See application file for complete search history.

(56) References Cited

U.S. PATENT DOCUMENTS

2004/0228657 A1 * 11/2004 Takahashi et al. ..... 399/149

FOREIGN PATENT DOCUMENTS

| | | | |
|---|---|---|---|
| JP | 62040483 A | * | 2/1987 |
| JP | 05-204282 | | 8/1993 |
| JP | 09-185302 | | 7/1997 |
| JP | 10-123775 | | 5/1998 |
| JP | 2001-142366 | | 5/2001 |
| JP | 2003-295555 A | | 10/2003 |

* cited by examiner

*Primary Examiner*—David M Gray
*Assistant Examiner*—Laura K Roth
(74) *Attorney, Agent, or Firm*—Nixon & Vanderhye, PC

(57) ABSTRACT

An image forming apparatus and a method for cleaning a photoreceptor are realized that allow cleaning a surface of the photoreceptor to eliminate foreign substances adhering thereto, without using a special abrasive sheet. A recording sheet is fed and brought into contact with photoreceptors of all photoreceptor drums. The recording sheet is stopped by causing the vicinity of a rear end of the recording sheet to be sandwiched between a pair of registration rollers. Then, the photoreceptor drums are rotated. By this way, the cleaning is carried out to the photoreceptor.

14 Claims, 6 Drawing Sheets

IMAGE FORMING APPARATUS CAPABLE OF CLEANING A PHOTORECEPTOR, METHOD FOR CLEANING A PHOTORECEPTOR, AND COMPUTER PROGRAM FOR CAUSING AN IMAGE FORMING APPARATUS TO CLEAN A PHOTORECEPTOR

This Nonprovisional application claims priority under 35 U.S.C. §119(a) on Patent Application No. 313209/2005 filed in Japan on Oct. 27, 2005, the entire contents of which are hereby incorporated by reference.

FIELD OF THE INVENTION

The present invention relates to an image forming apparatus, such as a copying machine, a printer, a facsimile machine, and a printing machine, that forms an image on a recording medium by an electrophotographic process or an electrostatic recording process, which image forming apparatus allows cleaning a surface of a holding member, such as a photoreceptor drum, to eliminate a foreign substance adhering to the surface of a photoreceptor.

BACKGROUND OF THE INVENTION

In an electrophotographic image forming apparatus, generally, an electrostatic latent image is formed on a surface layer of a photoreceptor drum, and then the electrostatic latent image is developed by use of developer, such as toner, so that a developer image that is yet fixed is formed. Thereafter, a sheet recording medium is brought into contact with the photoreceptor drum by a transfer section to transfer the developer image to the recording medium. After the developer image is transferred, a fixing section applies heat and pressure to the developer image so that the developer image is fixed to the recording medium.

A photoreceptor drum with a so-called organic photoreceptor is widely used as the photoreceptor drum. The organic photoreceptor is manufactured by dispersing fine particles of photoconductive material into a mixture liquid in which a charge transport material and a resin are solved, and then applying the mixture liquid to a surface of a base of the drum and drying it, thereby forming a photoreceptor layer.

If foreign substances, such as residual fine-particle developer and a slip of paper, adhere to the surface layer of the photoreceptor drum and deteriorate, a film or a black spot of toner may be formed. Therefore, it is necessary to eliminate the foreign substances adhering to the surface. For this reason, a cleaning blade is provided in such a way as to be in contact with the photoreceptor drum, for the purpose of rubbing off the foreign substances adhering to the surface.

However, if the contact pressure of the blade is too low, then the foreign substances adhering to the surface of the photoreceptor drum are not eliminated sufficiently. As a result, the surface becomes significantly contaminated. This causes a negative effect such as formation of a film that is described above, and therefore the performance is degraded. Thus, the blade is brought into contact with the surface layer of the photoreceptor drum such that the surface layer is scoured to some degree, in order to recover the performance.

On the other hand, if the contact pressure of the blade is too high, then a problem may be caused that the surface of the photoreceptor drum may abraded unevenly due to scouring effect by an end part of the blade.

Accordingly, there has been a need for a technique that allows a surface layer of a photoreceptor drum to be cleaned suitably. Note that the term "scouring" in the description of the present application means scrapping more or less the photoreceptor layer.

Document 1 below teaches a conventional technique in which a surface layer of a photoreceptor drum is scoured so as to recover its performance.

[Document 1] Japanese Unexamined Patent Publication No. 204282/1993 (Tokukaihei 5-204282)(published on Aug. 13, 1993)

In the conventional technique, a driving force of a drive motor is transmitted to a feed roller and a photoreceptor drum via a first and second clutches. Specifically, the first clutch is turned on to transmit the driving force of the drive motor to the feed roller, and the feed roller feeds a recording sheet from a sheet feeding section to a transfer section, in normal feeding of recording sheets. The second clutch is also turned on so as to cause the photoreceptor drum to perform development and transferring at an appropriate timing.

On the other hand, during the scouring, an abrasive sheet including abrasive particles, instead of a recording sheet, is fed into a main body of the copying machine. The abrasive sheet is used to scour a photoreceptor drum of the copying machine. Then, while the abrasive sheet exists at the photoreceptor drum, the first clutch is turned off so as to stop the feeding of the abrasive sheet. While the abrasive sheet is kept in contact with the photoreceptor drum, the second clutch is turned on so that the driving force of the drive motor is transmitted to the photoreceptor drum. This causes the photoreceptor drum to be rotated so as to allow the abrasive sheet to scour the surface layer of the photoreceptor drum.

Further, a similar technique is taught in Document 2 below.

[Document 2] Japanese Unexamined Patent Publication No. 185302/1997 (Tokukaihei 9-185302)(published on Jul. 15, 1997)

However, with the techniques of Documents 1 and 2, it is necessary to place a special abrasive sheet, in addition to a recording sheet, at the feeding section, for the purpose of eliminating the foreign substances adhering to the surface of the photoreceptor. This causes an inconvenience in handling. Furthermore, the special abrasive sheet is used so that it becomes necessary to provide a feeding section, in addition to the sheet feeding section, for storing the special abrasive sheets. This causes the structure of the apparatus, especially the structure relating to the sheet feeding section such as a feeding section of the copying machine, to be complicated. Therefore, miniaturization of the apparatus, improvement in economical efficiency, and facilitation of maintenance are disturbed.

SUMMARY OF THE INVENTION

The present invention is in view of the conventional problems described above, and has as an object to realize a method for cleaning a photoreceptor, which method includes the step of cleaning a surface of the photoreceptor to eliminate foreign substances adhering thereto, without using a special abrasive sheet. The present invention also has as an object to realize an image forming apparatus that allows the cleaning to be performed to eliminate foreign substances adhering to the surface of the photoreceptor, without using a special abrasive sheet. The present invention also has as an object to realize a program for carrying out the method for cleaning a photoreceptor, and a storage medium storing the program.

In order to solve the above problems, a method for cleaning a photoreceptor according to the present invention is adapted so that the method includes (i) preparing a contact-stopping state where a recording sheet fed through a feeding path is stopped while being in contact with the surface of the photoreceptor of a photoreceptor drum; and (ii) rotating the photoreceptor drum during the contact-stopping state.

According to the above invention, the recording sheet is fed through the feeding path, and brought into contact with the surface of the photoreceptor of the photoreceptor drum. Then, the recording sheet is stopped while being in contact with the surface. Thereafter, while the recording sheet is kept in the contact-stopping state, the photoreceptor drum is rotated. At this time, the recording sheet touches the surface of the photoreceptor so as to clean it. As such, foreign substances, such as a film, adhering to the surface are eliminated. The cleaning is performed by use of the recording sheet P, so that it is not necessary to use a special abrasive sheet.

By this way, a method for cleaning the photoreceptor is realized that the cleaning is performed to eliminate foreign substances adhering to the surface of the photoreceptor, without using a special abrasive sheet.

Further, the cleaning is performed by use of the recording sheet P. This makes it possible to utilize the sheet-feeding mechanism and the feeding path that are used for the recording sheets, and therefore miniaturization of the image forming apparatus 100, improvement in economical efficiency, and facilitation of maintenance are not disturbed.

In order to solve the above problems, an image forming apparatus according to the present invention is adapted so that, in an image forming apparatus that forms an image on a recording sheet by use of a photoreceptor drum, a cleaning is carried out to a surface of a photoreceptor of the photoreceptor drum by (i) preparing a contact-stopping state where a recording sheet fed through a feeding path is stopped while being in contact with the surface of the photoreceptor of the photoreceptor drum, and (ii) rotating the photoreceptor drum during the contact-stopping state.

With the above invention, an image forming apparatus is realized that allows the cleaning to be performed to eliminate foreign substances adhering to the surface of the photoreceptor, without using a special abrasive sheet.

Further, the cleaning is performed by use of the recording sheet. This makes it possible to utilize the sheet-feeding mechanism and the feeding path that are used for the recording sheets, and therefore miniaturization of the image forming apparatus, improvement in economical efficiency, and facilitation of maintenance are not be disturbed.

In order to solve the above problems, a program of the present invention causes a computer to carry out the method for cleaning a photoreceptor.

With the above invention, it becomes possible to carry out the method for cleaning a photoreceptor as long as a computer function is provided. This gives versatility to the method.

In order to solve the above problems, a storage medium of the present invention stores the program in such a way as to be readable by a computer.

With the above invention, it becomes easy to distribute the program for causing the method for cleaning a photoreceptor to be carried out. Furthermore, it becomes easy to install the program on a computer.

Additional objects, features, and strengths of the present invention will be made clear by the description below. Further, the advantages of the present invention will be evident from the following explanation in reference to the drawings.

DESCRIPTION OF THE EMBODIMENTS

First Embodiment

The following describes an embodiment of the present invention, with reference to FIGS. 1 to 7.

Figure 6:
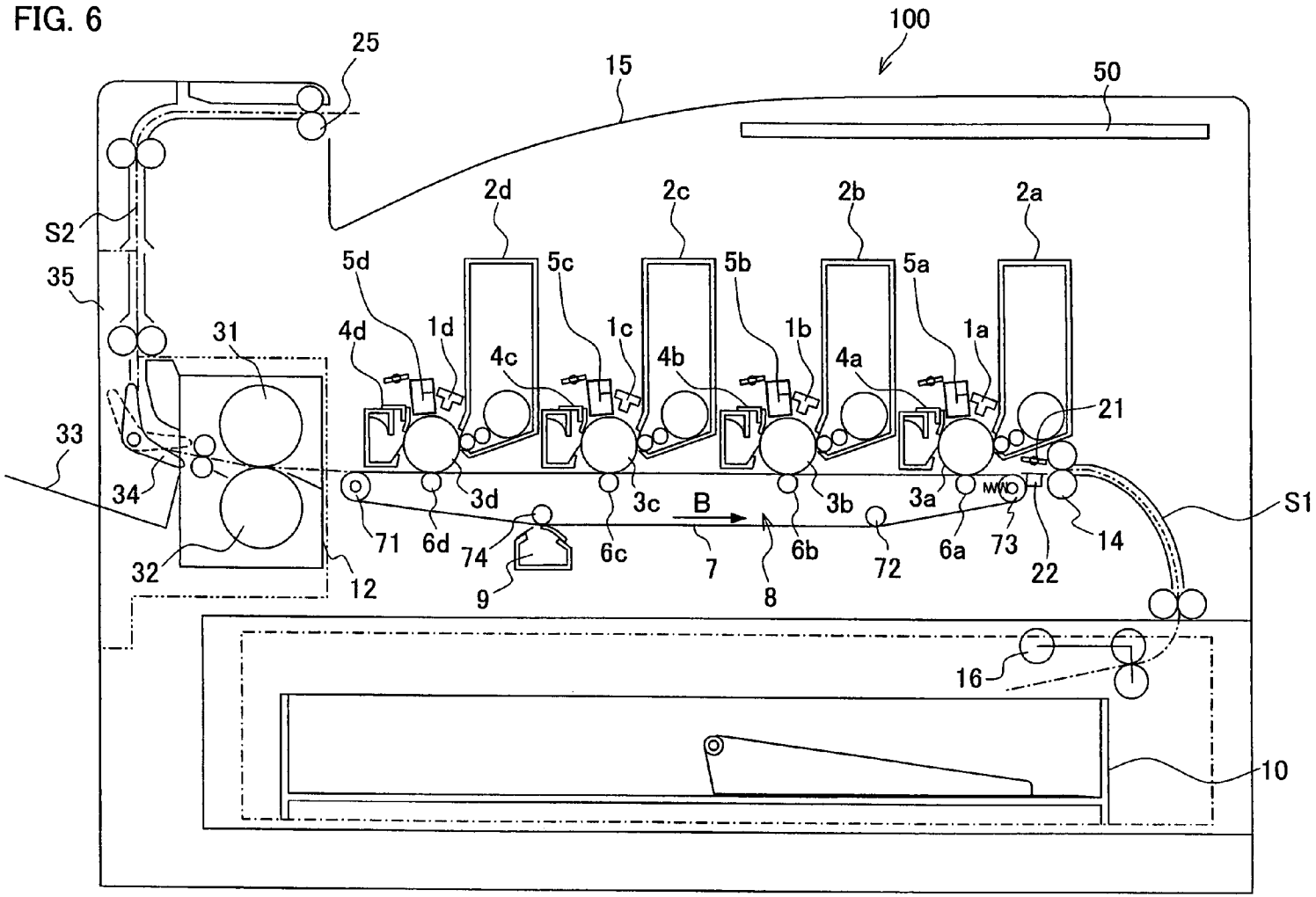
FIG. 6 is a cross sectional diagram schematically illustrating an image forming apparatus of an embodiment of the present invention.

FIG. 6 illustrates a structure of an electrophotographic image forming apparatus 100 according to the present embodiment. In the following description, the image forming apparatus 100 will be described as a printer section of a copying machine. It is also possible to employ a facsimile machine, or a Multi Function Printer including an additional function, such as a scanner function and a facsimile function.

The image forming apparatus 100 is a tandem-type image forming apparatus, and includes-four image forming stations: an image forming station Bk (black), an image forming station C (cyan), an image forming station M (magenta), and an image forming station Y (yellow). The image forming station Bk is provided at a most upstream part of a recording-sheet feeding path. In the image forming station Bk, a charging unit 1*a*, a development unit 2*a*, a transfer roller 6*a*, a cleaner unit 4*a*, and a charge eliminating unit 5*a* are provided around a photoreceptor drum 3*a*. The image forming station C is provided downstream, next to the image forming station Bk. In the image forming station C, a charging unit 1*b*, a development unit 2*b*, a transfer roller 6*b*, a cleaner unit 4*b*, and a charge eliminating unit 5*b* are provided around a photoreceptor drum 3*b*. The image forming station M is provided downstream, next to the image forming station C. In the image forming station M, a charging unit 1*c*, a development unit 2*c*, a transfer roller 6*c*, a cleaner unit 4*c*, and a charge eliminating unit 5*c* are provided around a photoreceptor drum 3*c*. The image forming station Y is provided downstream, next to the image forming station M. In the image forming station Y, a charging unit 1*d*, a development unit 2*d*, a transfer roller 6*d*, a cleaner unit 4*d*, and a charge eliminating unit 5*d* are provided around a photoreceptor drum 3*d*. These image forming stations perform a so-called Carlson process. Note that, although not illustrated in the figure, a laser scanning unit is provided above the photoreceptor drums 3*a* to 3*d* to expose photoreceptors charged by the charging unit 1*a* to 1*d*, respectively.

There is provided a transfer belt 7 suspended by a driving roller 71 and a pulley 73, which also acts as a tension roller, to form a feeding path along the respective image forming stations. The transfer belt 7 rotates in direction B indicated in the figure, moving from the image forming station Bk to the image forming station C, and then to the image forming station M, and thereafter to the image forming station Y, along a rotation path on the image forming station side. The transfer belt 7 is provided between the photoreceptor drum and the transfer roller of each of the respective image forming stations. While held on a surface, on the photoreceptor drum 3*a* side, of the transfer belt 7, a recording sheet is fed from the image forming station Bk to the image forming station Y. A rotation path, on the opposite side to the image forming stations, of the transfer belt 7 is suspended, from the inside, by the tension rollers 72 and 74. A cleaner unit 9 is provided in contact, from the outside, with this rotation path. The cleaner unit 9 cleans the surface of the transfer belt 7. Note that the unit of the transfer belt 7 and the transfer rollers 6*a* to 6*d* are movable in a rotary and downward direction about a pulley 73 side of the transfer belt 7. With this, it becomes also possible to perform an image forming operation in which the image forming station Bk is solely used. A sheet feeding cassette 10, in which recording sheets are kept, is provided below the respective image forming stations and the transfer belt 7. A pick up roller 16 is provided, at a feeding aperture of the sheet feeding cassette 10, to feed a recording sheet. There is formed a feeding path S1 from the feeding aperture to an immediate vicinity of the pulley 73 of the transfer belt 7. A pair of registration rollers 14 are provided at an end of the feeding path S1, in other words at the immediate vicinity of the pulley 73. The registration rollers 14 are used to adjust a timing when a recording sheet that is fed is sent to the image forming stations. An optical recording-sheet detecting section is provided, downstream of the feeding path, next to the pair of registration rollers 14. The optical recording-sheet detecting section is constituted of a pair of a light 21 and a line sensor 22 that are provided to sandwich, from the top and the bottom, the feeding path. When a front end of a recording sheet passes a space between the light 21 and the line sensor 22, the optical recording-sheet detecting section detects that the recording sheet is fed to the image forming station Bk. Note that a manual sheet-feeding tray may be provided to an exterior face of a housing 35 of the image forming apparatus 100. A recording sheet that is used in cleaning a photoreceptor, which cleaning will be described below in the present embodiment, may be fed from the manual sheet-feeding tray or from the sheet feeding cassette 10.

A fuser unit 12 is provided further downstream the feeding path of the transfer belt 7, and fixes an image formed on the recording sheet while the recording sheet passes by the respective image forming stations. The fuser unit 12 is constituted of a pair of a heat roller 31 and a pressure roller 32. The recording sheet is passed a space between the heat roller 31 and the pressure roller 32 so that the image is pressed and heated.

An ejection tray 33 and a feeding path S2 are provided downstream of the fuser unit 12. The ejection tray 33 is provided in such a way as to protrude from an exterior face of the housing 35 of the image forming apparatus 100. The feeding path S2 extends upward and then is bent into a horizontal direction to an ejected-sheet tray 15, which is formed on a top face of the housing 35, in the housing 35 of the image forming apparatus 100. A switch point 34 is provided at an ejection aperture of the fuser unit 12 to connect the path to the ejection tray 33 or the feeding path S2. Sheet ejection rollers 25 are provided at an end of the feeding path S2.

Figure 7:
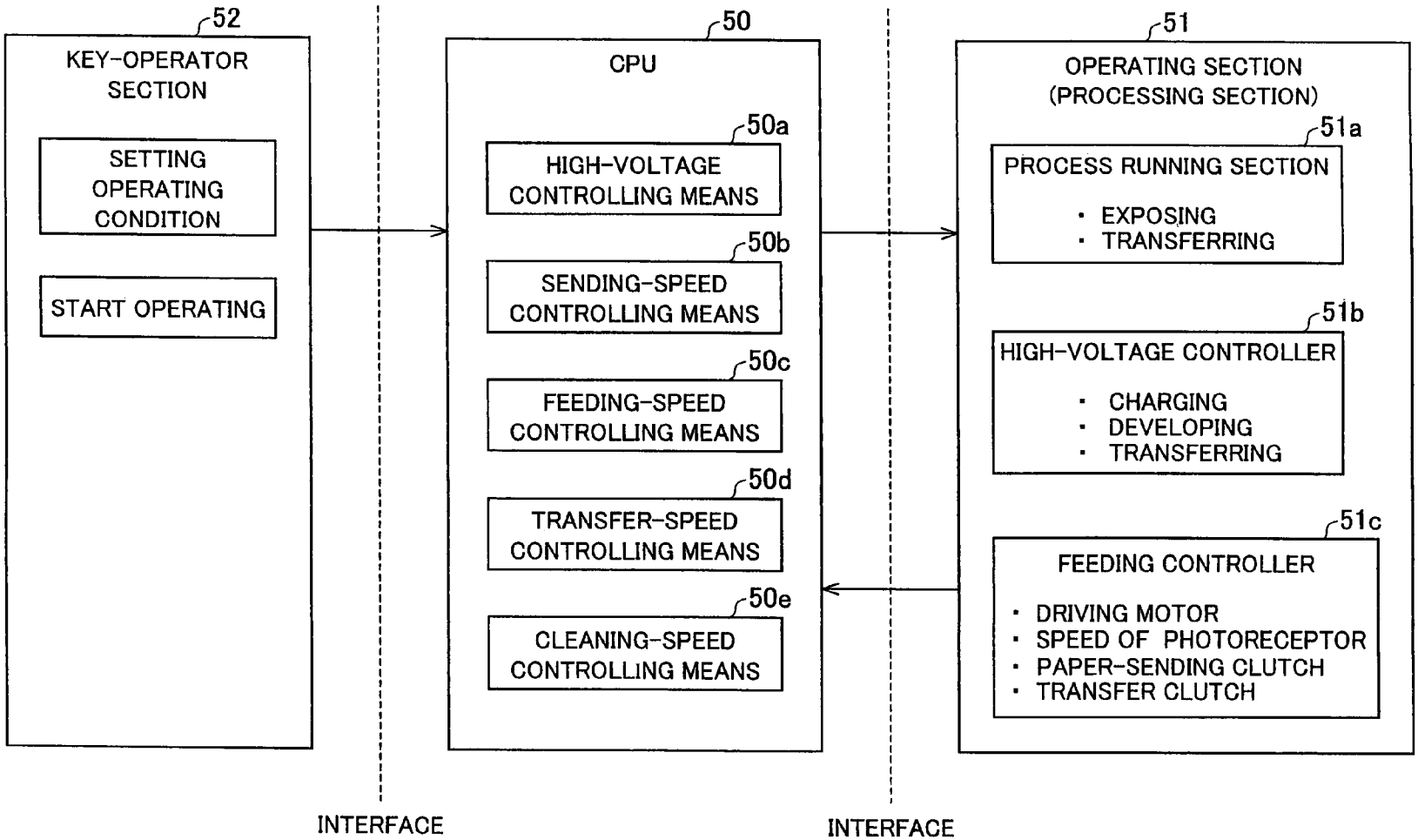
FIG. 7 is a block diagram illustrating (i) a structure of a controller and (ii) an arrangement of control blocks of the image forming apparatus of FIG. 6.

Further, a controller 50 is provided at an upper part of the image forming station. The controller 50 controls operations such as formation of images and feeding of recording sheets. FIG. 7 illustrates a concrete structure of the controller 50 and a structure of control blocks, with the controller 50 at the center.

The controller 50 is constituted of a CPU and a program that is combined with the CPU, and includes high-voltage controlling means 50*a*, sending-speed controlling means 50*b*, feeding-speed controlling means 50*c*, transfer-speed controlling means 50*d*, cleaning-speed controlling means 50*e* and the like. The controller 50 controls, via an interface, an operating section 51 that causes an execution of operations of the image forming apparatus 100, such as formation of an image and feeding of a recording sheet. The operating section 51 includes a process running section 51a, a high-voltage controller 51*b*, a feeding controller 51*c* and the like.

The high-voltage controlling means 50*a* of the controller 50 transmits, to the high-voltage controller 51*b* of the operating section 51, a control signal to cause an application of a high voltage. In response to the control signal, the high-voltage controller 51*b* applies a grid voltage to the charging units 1*a* to 1*d*, a development bias to the development units 2*a* to 2*d*, and/or a transfer voltage to the transfer rollers 6*a* to 6*d*.

The sending-speed controlling means 50*b* of the controller 50 transmits a control signal to the process running section 51*a* of the operating section 51. In response to the control signal, the process running section 51*a* adjusts timings of the entire process, such as a timing of driving the photoreceptor drums 3*a* to 3*d* and a timing of driving the transfer rollers 6*a* to 6*d*.

The feeding-speed controlling means 50*c* of the controller 50 transmits a control signal to the feeding controller 51*c* of the operating section 51. In response to the control signal, the feeding controller 51*c* drives a driving motor of respective feed rollers, regulates a speed of the respective photoreceptor drums 3*a* to 3*d*, operates a paper-sending clutch that separates a driving-force transmission shaft of the respective feed rollers or brings the driving-force transmission shaft into contact, operates a transfer clutch, and performs other operations. The transfer clutch is used for separating the driving-force transmission shaft of the respective transfer rollers 6*a* to 6*d*, bringing the driving-force transmission shaft into contact, or lifting up and down the transfer roller.

Further, the transfer-speed controlling means 50*d* of the controller 50 transmits a control signal to the feeding controller 51*c* of the operating section 51. In response to the control signal, the feeding controller 51*c* regulates, in accordance with the speed of the respective photoreceptor drums 3*a* to 3*d*, a speed of the driving roller 71 of the transfer belt 7 and a speed of the respective transfer rollers 6*a* to 6*d*.

The cleaning-speed controlling means 50*e* of the controller 50 transmits a signal to the process running section 51*a* and/or the feeding controller 51*c* of the operating section 51 to regulate a speed of the respective photoreceptor drums 3*a* to 3*d*, the respective transfer rollers 6*a* to 6*d*, the driving roller 71 and the like, during a cleaning of a photoreceptor. The cleaning of the photoreceptor will be described below.

Further, the image forming apparatus 100 is provided with a key-operator section 52. Instructions for setting operating conditions and starting operations are transmitted from the key-operator section 52 to the controller 50 via the interface.

The following describes a method for cleaning a photoreceptor of the respective photoreceptor drums 3*a* to 3*d* in the image forming apparatus 100 with the above structure. Note that the photoreceptor in the following description is an organic photoreceptor in the same manner as described above.

Figure 1:
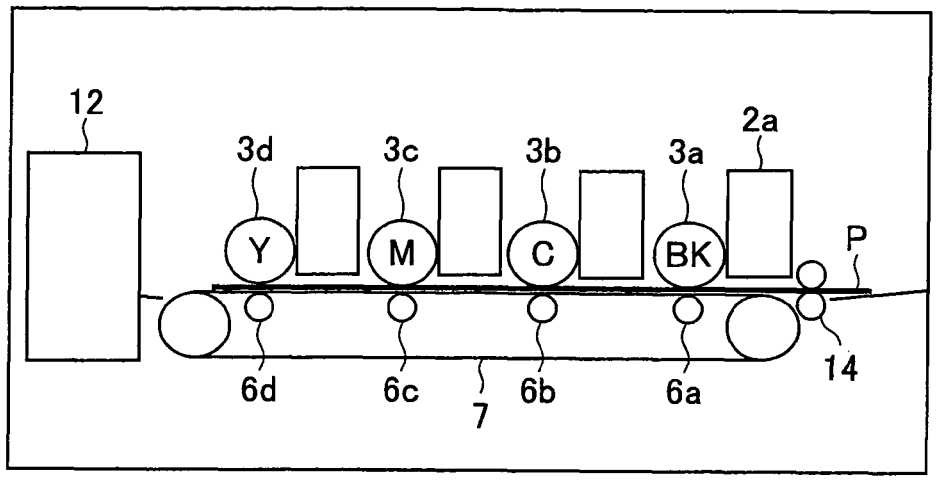
FIG. 1 is a cross sectional diagram showing a state of an image forming apparatus during an exemplary cleaning of a photoreceptor, according to an embodiment of the present invention.

FIG. 1 shows a state of the image forming apparatus 100 during the cleaning of the photoreceptor. Note that the structure of the image forming apparatus 100 is illustrated schematically. As illustrated in the figure, one sheet of recording sheet P is used as a cleaning sheet in the present embodiment. A thick paper that is thicker than a commonly-used recording sheet for printing that has a basis weight of approximately 70 $g/m^2$ is used as the recording sheet P. The thick paper needs to have a basis weight of at least 100 $g/m^2$ or greater, and it is preferable that the surface of the thick paper be as rough as possible, for example 60 Bekk seconds (smoothness measured by a method using a Bekk smoothness tester, JISP8119) or below. The size of the recording sheet P illustrated in FIG. 1 is A3 (420 mm×297 mm).

The recording sheet is fed through the same feeding path through which an ordinary recording sheet is fed, from the manual sheet-feeding tray or the sheet feeding cassette 10, both of which are described above, to the image forming station. The recording sheet P is placed such that the length of the recording sheet P comes along the feeding direction. The recording sheet P thus fed is brought into contact with surfaces of all photoreceptors of the photoreceptor drums 3*a* to 3*d*. Then, the recording sheet P is stopped while being kept in contact with the surfaces. At this time, an end part of the recording sheet P is sandwiched between the pair of registration rollers 14. By this way, a contact-stopping state forming step is carried out to bring the recording sheet P into a contact-stopping state. Then, while keeping the recording sheet P in the contact-stopping state, a rotating-driving step is carried out to simultaneously rotate the photoreceptor drums 3*a* to 3*d*. At this time, the recording sheet P touches the surfaces of the photoreceptors and clean the surfaces of the photoreceptor. As such, foreign substances, such as a film, adhering to the surfaces are eliminated. The cleaning is performed by use of the recording sheet P, so that it is not necessary to use a special abrasive sheet.

By this way, the cleaning is performed to eliminate foreign substances adhering to the surfaces of the photoreceptors, without using a special abrasive sheet. Further, the cleaning is performed by use of the recording sheet P. As such, it is possible to utilize the sheet-feeding mechanism and the feeding path that are used for the recording sheets, and therefore miniaturization of the image forming apparatus 100, improvement in economical efficiency, and facilitation of maintenance would not be disturbed.

The following describes a suitable number of rotations of the photoreceptor drums 3*a* to 3*d* in the rotating-driving step of the cleaning.

Table 1 shows the results of cleaning effects in relation to the number of rotations of the photoreceptor drums.

TABLE 1

| EXAMPLE | NUMBER OF ROTATION OF PHOTO-RECEPTOR DRUM | CLEANING EFFECT | REMARKS |
|---|---|---|---|
| EXAMPLE 1 | 1 | AVERAGE | |
| EXAMPLE 2 | 3 | GOOD | |

TABLE 1-continued

| EXAMPLE | NUMBER OF ROTATION OF PHOTO-RECEPTOR DRUM | CLEANING EFFECT | REMARKS |
|---|---|---|---|
| EXAMPLE 3 | 5 | GOOD | |
| EXAMPLE 4 | 0.5 | POOR | SOME PORTIONS WERE NOT CLEANED |
| EXAMPLE 5 | 7 | POOR | TONER WAS ACCUMULATED ON SHEET, AND THEREFORE CLEANING EFFECT WAS DEGRADED |
| EXAMPLE 6 | 10 | POOR | TONER WAS ACCUMULATED ON SHEET, AND THEREFORE CLEANING EFFECT WAS DEGRADED PHOTORECEPTOR WAS SCRATCHED |

When the photoreceptor drum was rotated 0.5 times, some portions of the surface of the photoreceptor was not cleaned. When the photoreceptor drum was rotated one time, a cleaning effect of practically-acceptable level was obtained. When the photoreceptor drum was rotated three times and five times, a great cleaning effect was obtained in both cases. When the photoreceptor drum was rotated seven times, toner adhering to the photoreceptor moved to the recording sheet P and was accumulated on the recording sheet P. This caused the cleaning effect to be degraded. When the photoreceptor drum was rotated ten times, the photoreceptor was scratched.

The above results were compared in detail. As a result, it was found that a suitable number of rotation was one time or more and five times or fewer. If the photoreceptor drum is rotated one time or more, the entire surface of the photoreceptor is cleaned. If the photoreceptor drum is rotated five times or fewer, the cleaning effect is prevented from being degraded due to dirt adhering to the recording sheet P, while the surface of the photoreceptor is prevented from being scratched.

Further, it is possible to carry out the above cleaning for plural times. In order to do so, an additionally feeding-moving step is carried out to feed and move, after the rotating-driving step, the recording sheet P used in the cleaning, downstream in the feeding direction. At this time, in consideration that there are provided plural photoreceptor drums, the recording sheet P is moved by a distance that is shorter than a distance from the photoreceptor drum to the adjacent photoreceptor drum. As such, a portion of the recording sheet P that is already used in the cleaning is not brought into contact with a photoreceptor drum of other color on the downstream side. By this way, the cleaning is carried out for plural times on the entire surfaces of all of the photoreceptors, with the use of different and clean portions of one single recording sheet P. The distance between the photoreceptor drums is called a process pitch. For example, in the case where the photoreceptor drum has a diameter of 30 mm, the process pitch is approximately 95 mm. Then, a set of the contact-stopping state forming step and the rotating-driving step is repeated. The set of the contact-stopping state forming step and the rotating-driving step may be repeated for an arbitrary number of times. Each time the set of the contact-stopping state forming step and the rotating-driving step is repeated, the additionally feeding-moving step is carried out between one set and the following set.

Figure 2:
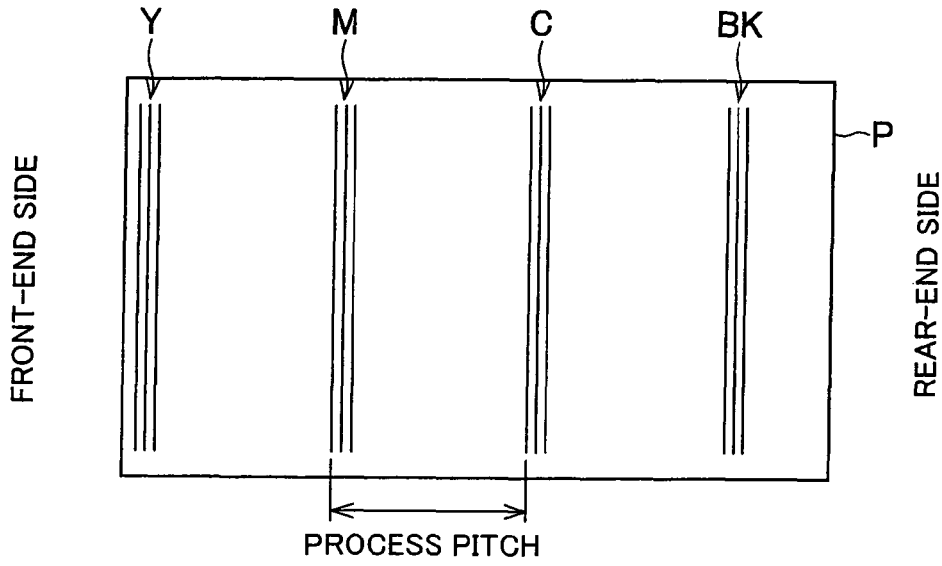
FIG. 2 is a plane diagram showing a state of a recording sheet on which a trace of cleaning is exhibited.

As a result, traces of the cleanings of the respective photoreceptor drums Y, M, C, and Bk are left on portions of the recording sheet P that are used in the cleanings. Specifically, as shown in FIG. 2, the traces that are shifted from each other for the process pitch are left from a front end to a rear end of the recording sheet P. The number of the traces are same as the number of the cleanings.

After the cleaning is finished, the recording sheet P is ejected to the outside of the apparatus through the same feeding path through which an ordinary recording sheet is fed.

In the foregoing, the cleaning is carried out on all of the photoreceptors of Bk, C, M, and Y, but it is possible to carry out the cleaning only on the photoreceptor of Bk.

Figure 3:
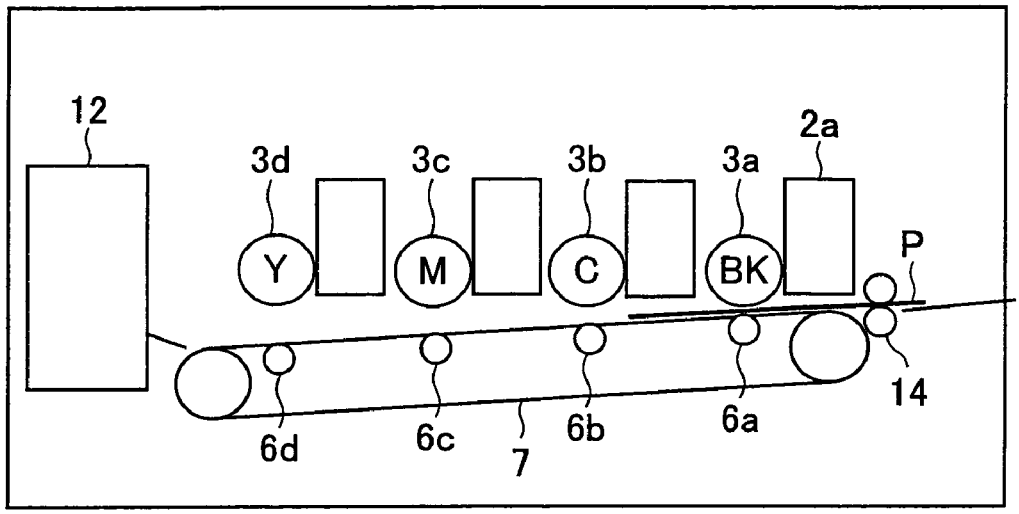
FIG. 3 is a cross sectional diagram showing a state of the image forming apparatus during another exemplary cleaning of the photoreceptor, according to an embodiment of the present invention.

FIG. 3 shows a state of the image forming apparatus 100 during a sole cleaning of the photoreceptor of Bk. In the figure, the unit of the transfer belt 7 and the transfer rollers 6*a* to 6*d* are moved in a rotary and downward direction about a pulley 73 side of the transfer belt 7. At this time, the transfer roller 6*a* and the transfer belt 7 are not separated from the photoreceptor drum 3*a* of Bk. One recording sheet P which is a thick paper of A4-size (297 mm×210 mm) is used in the cleaning. The recording sheet P is placed such that a width of the recording sheet P comes along the feeding direction. The vicinity of a rear end of the recording sheet P is sandwiched between the pair of registration rollers 14. By this way, the contact-stopping state forming step and the rotating-driving step are carried out. When these steps are repeated, the additionally feeding-moving step is carried out. After the cleaning is finished, the recording sheet P is ejected out of the apparatus, in the same manner as in forming an image with the use solely of Bk.

Figure 4:
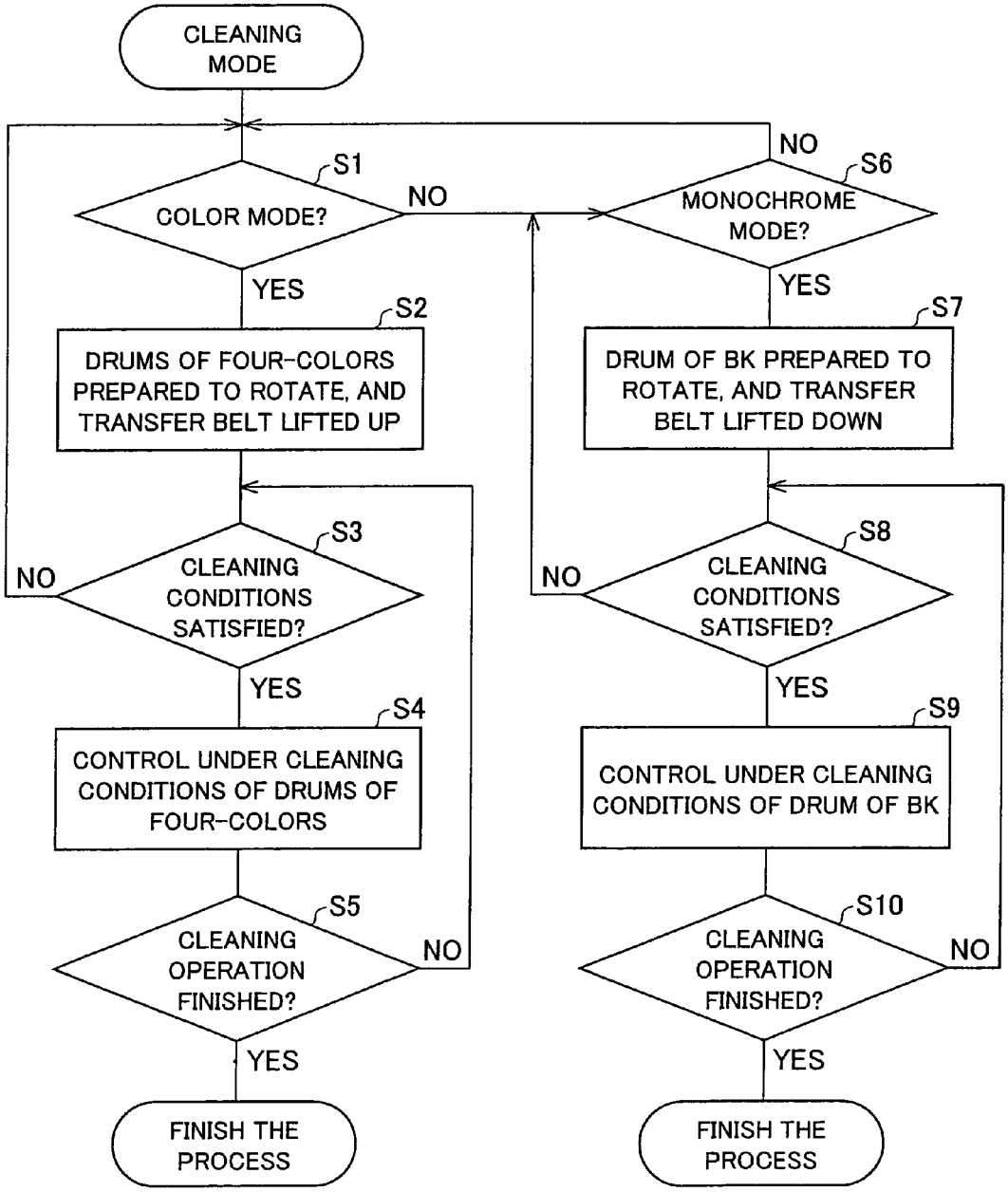
FIG. 4 is a flow chart showing a flow of cleaning a photoreceptor, according to an embodiment of the present invention.

FIG. 4 shows a flow chart explaining the above-described method for cleaning a photoreceptor.

The processes of the method are started when a cleaning mode is begun as a result that a maintenance person or other person operates the key-operator section 52 illustrated in FIG. 7 to cause the program of the method for cleaning a photoreceptor to be read out and therefore carried out.

It is determined in S1 whether the mode selected by the key-operator section 52 is a color mode where the cleaning is to be carried out on all of the photoreceptors of Bk, C, M, and Y. If it is determined that the mode is the color mode, then the process flow goes to S2. If it is determined that the mode is not the color mode, then the process flow goes to S6 that will be described below. In S2, the unit of transfer belt 7 and the transfer rollers 6*a* to 6*b* are rotated and lifted up so as to come into contact with all of the image forming stations.

In S3, it is determined whether cleaning conditions are satisfied. Exemplary cleaning conditions include: feeding of the recording sheet P is completed; and application of a development bias, a transfer voltage, or a charging voltage to the charging units 1*a* to 1*d*. The determination whether the feeding of the recording sheet P is completed is carried out as follows. When an input operation is made on the key-operator section 52, the recording sheet P is fed from the manual sheet-feeding tray or the sheet feeding cassette 10 to the image forming stations. Then, it is determined whether the optical recording-sheet detecting section, which is constituted of the light 21 and the line sensor 22 in FIG. 6, detects a sheet within a predetermined period of time, for example 10 seconds, after feeding of sheets is started. On the other hand, determination whether an application of a high voltage is completed is carried out by an electric detection. For example, the charging voltage (grid bias) is set at 700 V, the development bias is set at 500 V, and the transfer voltage is set at 500 V, and the charging voltage of 700 V, the development bias of 500 V, and the transfer voltage of 500 V are always supplied during the cleaning.

If it is determined in S3 that the cleaning conditions are satisfied, then the process flow goes to S4. If not, the process flow goes back to S1.

In S4, the cleaning is carried out under the conditions for cleaning all of the photoreceptors of four colors. At this time, a speed of the respective photoreceptor drums 3*a* to 3*d* is regulated at a designated speed, for example 117 mm/sec. The number of rotations is predetermined. As the speed of the respective photoreceptor drums 3*a* to 3*d* is predetermined, a desired number of rotations is controlled with a predetermined period of time, for example five seconds. Further, in the case where the additional feeding-moving step is carried out to perform the cleaning for plural times, a time period for moving the recording sheet P, for example 20 msec, is provided. In this case, the cleaning is performed for five seconds, then the recording sheet P is moved within 20 msec, and then the cleaning is performed again for five seconds, and so on. The processes are repeated accordingly.

It is determined in S5 whether the cleaning is finished by determining the recording sheet is ejected. If it is determined that the cleaning is finished, then the process flow is finished. If it is determined that the cleaning is not finished, then the process flow goes back to S3. The operation time period of the color mode takes six minutes and 45 seconds in the case where the cleaning is repeated 75 times, for example. It is possible to preset the operation time period.

On the other hand, if it is determined in S1 that the mode is not the color mode, then the process flow goes to S6. In S6, it is determined whether the mode is a monochrome mode where the cleaning is performed only on the photoreceptor of Bk. If it is determined that the mode is the monochrome mode, then the process flow goes to S7. If it is determined that the mode is not the monochrome mode, then the process flow goes back to S1. In S7, the unit of transfer belt 7 and the transfer rollers 6*b* to 6*d* are rotated and lifted down so as to be in a state where only the image forming station Bk is in use.

It is determined in S8 whether cleaning conditions are satisfied. Exemplary cleaning conditions include: feeding of the recording sheet P is completed; and application of a development bias, a transfer voltage, and a charging voltage to the charging unit 1*a*, which corresponds to Bk. For example, the charging voltage (grid bias) is set at the same voltage as that for forming an image, the development bias is also set at the same bias as that for forming an image, and the transfer voltage is set at 500 V. The charging voltage of the set value, the development bias of the set value, and the transfer voltage of the set value are supplied during the cleaning.

If it is determined in S8 that the cleaning conditions are satisfied, then the process flow goes to S9. If it is determined in S8 that the cleaning conditions are not satisfied, then the process flow goes back to S6.

In S9, the cleaning is carried out under the conditions for cleaning the photoreceptors of Bk. At this time, a speed of the photoreceptor drum 3*a* is regulated at a designated speed, for example 140 mm/sec. The number of rotations is predetermined. As the speed of the photoreceptor drum 3*a* is predetermined, a desired number of rotations is controlled with a predetermined period of time, for example three seconds. Further, in the case where the additional feeding-moving step is carried out to perform the cleaning for plural times, a time period for moving the recording sheet P, for example 30 msec, is provided. In this case, the cleaning is performed for three seconds, then the recording sheet P is moved within 30 msec, and then the cleaning is performed again for three seconds, and so on. The processes are repeated accordingly.

It is determined in S10 whether the cleaning is finished by determining the recording sheet is ejected. If it is determined that the cleaning is finished, then the process flow is finished. If it is determined that the cleaning is not finished, then the process flow goes back to S8. The operation time period of the monochrome mode takes two minutes and 45 seconds in the case where the cleaning is repeated 50 times, for example. It is possible to preset the operation time period.

The foregoing described the flow of the method for cleaning a photoreceptor. In both cases of the color mode and the monochrome mode, there is no difference in the image quality between (i) an image that is formed before the cleaning is carried out and (ii) an image that is formed after the cleaning is carried out. Furthermore, no adverse effect that causes a problem is generated.

The following describes another exemplary method for cleaning a photoreceptor.

Figure 5:
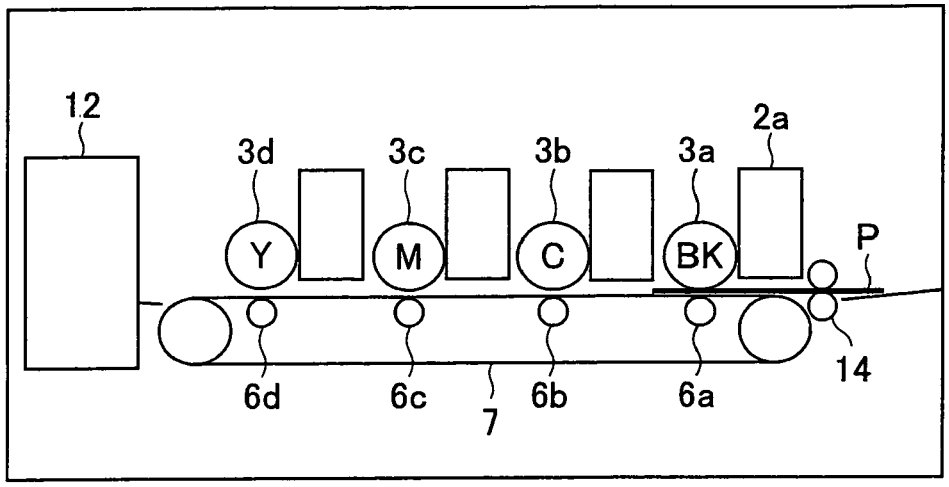
FIGS. 5(*a*) and 5(*b*) are cross sectional diagrams each showing a state of the image forming apparatus during another exemplary cleaning of the photoreceptor, according to an embodiment of the present invention.
Figure 5:
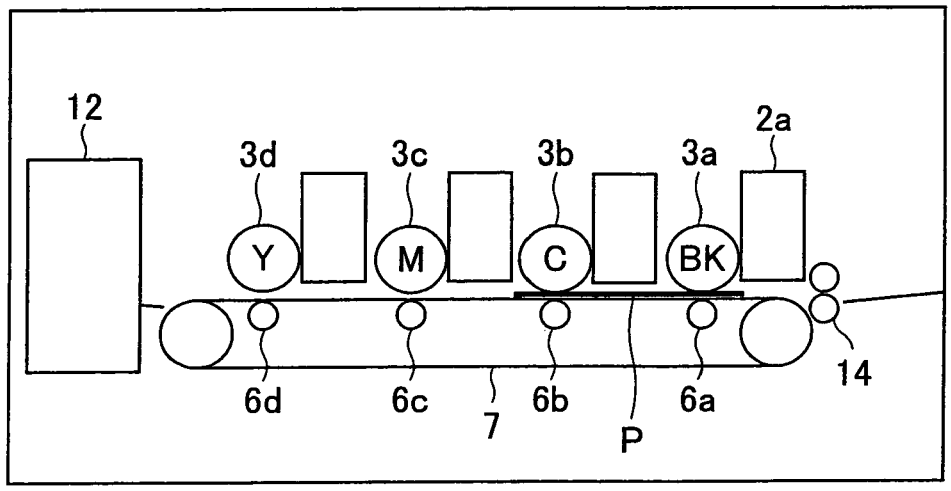

FIGS. 5(*a*) and 5(*b*) are diagrams each showing states of the image forming apparatus 100 in which the cleaning is sequentially carried out to each of the photoreceptors, one by one from the photoreceptor drum 3*a*, which is on a most upstream side, to the photoreceptor drums on a downstream side. One sheet of the recording sheet P, which is a thick paper of A4 size, is used as the cleaning sheet. The recording sheet P is placed such that the width of the recording sheet P comes along the feeding direction.

When the cleaning is carried out to the photoreceptor of Bk, the vicinity of the rear end of the recording sheet P is sandwiched between the pair of registration rollers 14 during the contact-stopping state forming step, as illustrated in FIG. 5(*a*). In the rotating-driving step, only the photoreceptor drum 3*a* is rotated. When the cleaning is to be carried out again with respect to the photoreceptor of Bk, the additionally feeding-moving step is carried out.

When the cleaning is carried out to the photoreceptor of C, which is provided downstream and adjacent to the photoreceptor of Bk, the recording sheet P is fed to the underneath of the photoreceptor drum 3*b*, which is the photoreceptor of C, as illustrated in FIG. 5(*b*). The recording sheet P is fed such that the photoreceptor of C is in contact with the recording sheet P while avoiding the trace of the cleaning of the photoreceptor of Bk is avoided. At this time, the vicinity of the rear end of the recording sheet P (also the transfer belt 7) is sandwiched between (i) the photoreceptor drum 3*a*, i.e., the photoreceptor drum of Bk, that is provided adjacently on the upstream side and is stopped, (ii) the transfer roller 6*a*, which is provided adjacently on the upstream side and is stopped, thereby carrying out the contact-stopping state forming step. The rotating-driving step and following steps are the same as those in the case of Bk.

In the same manner as to the photoreceptor of C, the cleaning is carried out sequentially to the photoreceptor of M and the photoreceptor of Y, while the vicinity of the rear end of the recording sheet P is sandwiched between (i) a photoreceptor drum that is provided adjacently on the upstream side and (ii) a transfer roller that is provided adjacently on the upstream side.

By this way of cleaning, it becomes possible to carry out the cleaning to all of the photoreceptor drums 3*a* to 3*d*, even when the cleaning is carried out by use of a recording sheet that is too small to come into contact with all of the photoreceptor drums at one time. Further, when the cleaning is carried out to the photoreceptor of a photoreceptor drum of C, M, or Y that is provided second or following in a feeding direction along the feeding path, the recording sheet is stopped by causing the recording sheet to be sandwiched between (i) a photoreceptor drum that is provided adjacently on the upstream side and (ii) a transfer roller that is provided adjacently on the upstream side. As such, it becomes possible to easily carry out the cleaning sequentially to the surfaces of the plurality of photoreceptors in the case where a recording sheet of small size is used, even if no special mechanism is provided to stop the recording sheet at plural predetermined positions.

Note that, although it was described above, with reference to FIG. 7, that the above method for cleaning the photoreceptor was realized by a program, the method may also be realized by use of hardware logic. In the case where the method is carried out by a program (software), the method is realized by, for example, the way as described below in detail.

Specifically, the image forming apparatus 100 includes: a CPU (central processing unit) for executing an instruction of a control program for realizing respective functions; a ROM (read only memory) for storing the program; a RAM (random access memory) for developing the program; and a storage medium, such as a memory, for storing the program and various data. The object of the present invention is also achieved by (i) supplying, to the controller 50, a computer-readable storage medium storing a program code (execute form program, intermediate code program, source program) of software for realizing the functions described above, and (ii) causing a computer (or CPU or MPU) to read out and carry out the program code stored in the storage medium.

Exemplary storage medium that may be used as the storage medium described above include: tapes such as a magnetic tape and a cassette tape; disks such as an magnetic disk (e.g., floppy (registered trademark) disk, hard disk) and an optical disk (e.g., CD-ROM, MO, MD, DVD, CD-R); cards such as an IC card (including memory card) and an optical card; and semiconductor memories such as a mask ROM, an EPROM, an EEPROM, and a flash ROM.

Further, it is also possible to make an arrangement that the controller 50 is allowed to be connected to a communication network, and the program code is supplied via the communication network. The communication network is not particularly limited, and the followings may be used as the communication network, for example: the Internet, intranet, extranet, LAN, ISDN, VAN, CATV communication network, virtual private network, telephone line network, mobile communication network, and satellite communication network. Further, transmission medium that configure the communication network is not particularly limited. For example, a wire transmission medium, such as IEEE 1394, USB, power line, cable TV circuit, telephone line, ADSL circuit, and a wireless transmission medium, such as infrared ray (e.g., IrDA, remote-controller), Bluetooth (registered trademark), IEEE 802.11, HDR, mobile telephone network, satellite circuit, and terrestrial digital network. Note that the present invention may also be realized in the form of a computer data signal that is realized by electrical transmission of the program code and embedded in a carrier.

The present invention is applicable to an image forming apparatus including any number of photoreceptor drums. The present invention is also applicable to an image forming apparatus of an electrostatic recording process. The present invention can be suitably used in copying machines, Multi Function Printers, facsimile machines and the like.

As described above, the method for cleaning a photoreceptor according to the present invention includes the steps of preparing a contact-stopping state and rotating the photoreceptor drum for cleaning a surface of the photoreceptor.

Further, as described above, in the image forming apparatus of the present invention, a cleaning is carried out to a surface of a photoreceptor of the photoreceptor drum by (i) preparing a contact-stopping state where a recording sheet fed through a feeding path is stopped while being in contact with the surface of the photoreceptor of the photoreceptor drum, and (ii) rotating the photoreceptor drum during the contact-stopping state.

By this way, a method for cleaning the photoreceptor is realized that the cleaning is performed to eliminate foreign substances adhering to the surfaces of the photoreceptors, without using a special abrasive sheet.

Further, it is preferable in the method that the photoreceptor drum be rotated one time or more and five times or fewer during the step (ii).

With the above arrangement, it becomes possible to clean the entire surface of the photoreceptor by rotating the photoreceptor drum one time or more. Furthermore, it also becomes possible to prevent (i) the cleaning effect from being degraded due to dirt adhering to the recording sheet and (ii) the surface of the photoreceptor from being scratched, by rotating the photoreceptor drum five times or fewer.

Further, the method for cleaning the photoreceptor may further include the steps of: (iii) feeding and moving, after the step (ii), the recording sheet used in the cleaning, downstream in a feeding direction, and (iv) repeating the steps (i) and (ii), after the step (iii), with respect to the photoreceptor drum, while using the recording sheet thus fed and moved in the step (iii).

In the above arrangement, the surface of the photoreceptor is cleaned for plural times by use of different portions of one single recording sheet. As such, the cleaning effect is improved.

Further, it is preferable in the method for cleaning the photoreceptor that, in a case where a plurality of photoreceptor drums are provided along the feeding path, the recording sheet be brought into contact with all of the photoreceptor drums in the step (i), and all of the photoreceptor drums are rotated in the step (ii).

With the above arrangement, it becomes possible to clean the surfaces of all photoreceptors at one time, in the case where the image forming apparatus includes a plurality of photoreceptor drums.

Further, the method for cleaning the photoreceptor may further include the steps of: (iii) feeding and moving, after the step (ii), the recording sheet used in the cleaning, downstream in a feeding direction by a distance that is shorter than a distance between adjacent ones of the photoreceptor drums, and (iv) repeating the steps (i) and (ii), after the step (iii), with respect to all of the photoreceptor drums, while using the recording sheet thus fed and moved in the step (iii).

With the above arrangement, it becomes possible to carry out the cleaning for a plurality of times on the entire surfaces of all of the photoreceptors, by use of different and clean portions of one single recording sheet.

Further, in the method for cleaning the photoreceptor, in a case where a plurality of photoreceptor drums are provided along the feeding path, the steps (i) and (ii) are carried out, while the recording sheet is fed, one by one from a most upstream side to a downstream side, between adjacent ones of the photoreceptor drums.

With the above arrangement, it becomes possible to carry out the cleaning to all of the plurality of photoreceptor drums, even when the cleaning is carried out by use of a recording sheet that is too small to be in contact with all of the photoreceptor drums at one time.

Further, it is preferable in the method for cleaning the photoreceptor that, during the step (i), when cleaning a surface of a photoreceptor of a second one or a following one, in a feeding direction, of the photoreceptor drums provided along the feeding path, the recording sheet be stopped by causing the recording sheet to be sandwiched between (i) an adjacent one of the photoreceptor drums on an upstream side and (ii) a transfer roller that is provided to transfer onto a recording sheet an image from the adjacent one of the photoreceptor drums.

With the above invention, it becomes possible to easily carry out the cleaning sequentially to the surfaces of the plurality of photoreceptors in the case where a recording sheet of small size is used, even if no special mechanism is provided to stop the recording sheet at plural predetermined positions.

The present invention is not limited to the description of the embodiments above, but may be altered by a skilled person within the scope of the claims. An embodiment based on a proper combination of technical means disclosed in different embodiments is encompassed in the technical scope of the present invention.

What is claimed is:

1. A method for cleaning a surface of a photoreceptor of an image forming apparatus, comprising the steps of:

(i) feeding a recording sheet into the image forming apparatus;

(ii) stopping the recording sheet so that it is in contact with the surface of the photoreceptor of a photoreceptor drum;

(iii) rotating the photoreceptor drum while the recording sheet is stopped to clean the surface of the photoreceptor;

(iv) feeding and moving, after step (iii), the recording sheet downstream in a feeding direction; and (v) repeating steps (ii) and (iii), after performing step (iv), using the same recording sheet.

2. The method according to claim 1, wherein the photoreceptor drum is rotated one time or more and five times or fewer during the step (iii).

3. The method according to claim 1, wherein the image forming apparatus comprises a plurality of photoreceptor drums that are provided along the feeding direction, wherein the recording sheet is brought into contact with all of the photoreceptor drums in the step (ii), and wherein all of the photoreceptor drums are rotated in the step (iii).

4. The method according to claim 3, wherein during step (iv) the recording sheet used in the cleaning is moved downstream in the feeding direction by a distance that is shorter than a distance between adjacent ones of the photoreceptor drums.

5. The method according to claim 1, wherein the image forming apparatus comprises a plurality of photoreceptor drums that are provided along the feeding direction, and wherein during the feeding, stopping and rotating steps, the recording sheet is fed, one by one from a most upstream side to a downstream side, between adjacent ones of the photoreceptor drums.

6. The method according to claim 5, wherein, during the stopping and rotating steps used to clean a photoreceptor of a second one or a following one, in a feeding direction, of the photoreceptor drums provided along the feeding direction, the recording sheet is stopped by causing the recording sheet to be sandwiched between (i) an adjacent one of the photoreceptor drums on an upstream side and (ii) a transfer roller that is provided to transfer onto a recording sheet an image from the adjacent one of the photoreceptor drums.

7. A computer-readable storage medium storing a program for causing an image forming apparatus to perform a method as recited in claim 1.

8. A method for cleaning surfaces of photoreceptor drums of an image forming apparatus that includes a plurality of photoreceptor drums arranged along a feeding direction, comprising the steps of:

(i) feeding a recording sheet into the image forming apparatus;

(ii) stopping the recording sheet so that it is in contact with a first one of the photoreceptor drums;

(iii) rotating the first photoreceptor drum while the recording sheet is in contact with the first photoreceptor drum to clean the photoreceptor drum;

(iv) moving the recording sheet further along the feeding direction and stopping the recording sheet so that it is in contact with a downstream photoreceptor drum located downstream of the first photoreceptor drum; and (v) rotating the downstream photoreceptor drum to clean the downstream photoreceptor drum.

9. The method of claim 8, further comprising repeating steps (iv) and (v) so that the recording sheet is successively brought into contact with and is used to clean each of the photoreceptor drums located downstream of the first photoreceptor drum.

10. A computer-readable storage medium storing a program for causing an image forming apparatus to perform the method as recited in claim 8.

11. An image forming apparatus, comprising:

means for feeding a recording sheet into the image forming apparatus;

means for stopping the recording sheet so that it is in contact with the surface of a photoreceptor drum of the image forming apparatus;

means for rotating the photoreceptor drum while the recording sheet is stopped;

means for feeding and moving the recording sheet downstream;

means for stopping the recording sheet so that it is still in contact with the photoreceptor drum; and means for again rotating the photoreceptor drum.

12. The image forming apparatus of claim 11, wherein the image forming apparatus includes a plurality of photoreceptor drums, wherein the means for stopping the recording sheet causes the recording sheet to be stopped when the recording sheet is in contact with all of the plurality of photoreceptor drums, and wherein the means for rotating the photoreceptor drum causes all of the plurality of photoreceptor drums to rotate.

13. The image forming apparatus of claim 12, wherein the means for stopping the recording sheet so that it is still in contact with the photoreceptor drum stops the recording sheet so that it is still in contact with all of the plurality of photoreceptor drums, and wherein the means for again rotating the photoreceptor drum causes all of the plurality of photoreceptor drums to rotate.

14. An image forming apparatus that includes a plurality of photoreceptor drums arranged along a feeding direction, comprising:

means for feeding a recording sheet into the image forming apparatus;

means for stopping the recording sheet so that it is in contact with a first one of the photoreceptor drums;

means for rotating the first photoreceptor drum while the recording sheet is in contact with the first photoreceptor drum to clean the first photoreceptor drum;

means for moving the recording sheet further along the feeding direction and stopping the recording sheet so that it is in contact with a downstream photoreceptor drum located downstream of the first photoreceptor drum; and means for rotating the downstream photoreceptor drum to clean the downstream photoreceptor drum.

* * * * *